US008199092B2

(12) United States Patent
Chen

(10) Patent No.: US 8,199,092 B2
(45) Date of Patent: Jun. 12, 2012

(54) LIQUID CRYSTAL DISPLAY HAVING COMMON VOLTAGE MODULATOR

(75) Inventor: Hung-Yu Chen, Miao-Li (TW)

(73) Assignee: Chimei Innolux Corporation, Miaoli County (TW)

( * ) Notice: Subject to any disclaimer, the term of this patent is extended or adjusted under 35 U.S.C. 154(b) by 980 days.

(21) Appl. No.: 12/154,829

(22) Filed: May 27, 2008

(65) Prior Publication Data

US 2008/0291144 A1 Nov. 27, 2008

(30) Foreign Application Priority Data

May 25, 2007 (CN) ..... 2007 1 0074608

(51) Int. Cl.
*G09G 3/36* (2006.01)

(52) U.S. Cl. ..... 345/94; 345/58

(58) Field of Classification Search ..... 345/89, 345/94, 58

See application file for complete search history.

(56) References Cited

U.S. PATENT DOCUMENTS 5,774,099 A * 6/1998 Iwasaki et al. ..... 345/87
5,831,605 A * 11/1998 Yasui et al. ..... 345/211
5,841,410 A * 11/1998 Oda et al. ..... 345/58
6,229,510 B1 5/2001 Kim et al.
2002/0027540 A1* 3/2002 Lee ..... 345/87
2003/0058204 A1* 3/2003 Moon ..... 345/87
2004/0169627 A1* 9/2004 Hong ..... 345/89
2005/0253836 A1* 11/2005 Kim et al. ..... 345/212
2006/0170640 A1* 8/2006 Okuno ..... 345/98
2006/0244704 A1 11/2006 JaeHun
2007/0024565 A1* 2/2007 Choi ..... 345/98
2008/0303967 A1* 12/2008 Huang et al. ..... 349/39
2009/0015528 A1* 1/2009 Sheu ..... 345/87

* cited by examiner

*Primary Examiner* — Chanh Nguyen
*Assistant Examiner* — Robert Stone
(74) *Attorney, Agent, or Firm* — Muncy, Geissler, Olds & Lowe, PLLC

(57) ABSTRACT

An exemplary liquid crystal display includes a common electrode capable of having a predetermined common voltage applied thereto, a first common voltage line connected to the common electrode, a second common voltage line connected to the common electrode, and a common voltage modulator connected to the first and second common voltage lines. The first and second common voltage lines have no overlap and being at opposite sides of the liquid crystal display. The common voltage modulator is configured to receive a distorted common voltage from the common electrode via the first common voltage line, and apply a corresponding compensating voltage to the common electrode via the second common voltage line.

3 Claims, 3 Drawing Sheets

LIQUID CRYSTAL DISPLAY HAVING COMMON VOLTAGE MODULATOR

FIELD OF THE INVENTION

The present invention relates to liquid crystal displays (LCDs) and the stabilizing of common voltages thereof, and more particularly to an LCD utilizing a common voltage modulator to keep the common voltage of the LCD stable.

BACKGROUND

Because many LCD devices have the advantages of portability, low power consumption, and low radiation, they have been widely used in various portable information products such as notebooks, personal digital assistants (PDAs), video cameras, and the like. Furthermore, LCD devices are considered by many to have the potential to completely replace cathode ray tube (CRT) monitors and televisions.

Referring to FIG. 4, a typical LCD 10 includes a liquid crystal panel 11, a timing controller 12, a gate driving circuit 13, a data driving circuit 14, and a common voltage source 15. The gate driving circuit 13 is used for providing a plurality of scanning signals to the liquid crystal panel 11. The data driving circuit 14 is used for providing a plurality of gray scale voltages to the liquid crystal panel 11. The timing controller 12 is used for controlling the gate driving circuit 13 and the data driving circuit 14. The common voltage source 15 is used for providing a predetermined common voltage to the liquid crystal panel 11.

The liquid crystal panel 11 includes a plurality of scanning lines 131 parallel to each other, a plurality of data lines 141 parallel to each other and orthogonal to the scanning lines 131, a common voltage line 101, a plurality of thin film transistors (TFTs) 16 arranged in the vicinity of points of intersection of the scanning lines 131 and the data lines 141, a plurality of pixel electrodes 17 corresponding to the TFTs 16, and a plurality of common electrodes 18 generally opposite to the pixel electrodes 17 respectively.

Each TFT 16 includes a gate electrode (not labeled) connected to the corresponding scanning line 131, a source electrode (not labeled) connected to the corresponding data line 141, and a drain electrode (not labeled) connected to the pixel electrode 17. The common electrodes 18 of the TFTs 16 are substantially connected together and to the common voltage source 15 via the common voltage line 101. The common voltage line 101 is insulated from the scanning lines 131 and the data lines 141, and is arranged at an edge of the liquid crystal panel 11 near the gate driving circuit 13. A plurality of branch lines (not labeled) extend from the common voltage line 101, each branch line connecting to a respective row of the common electrodes 18. Thereby, all the common electrodes 18 have the common voltage applied thereto. The common voltage is a constant direct current voltage, and may for example be 5 volts (V).

The timing controller 12 generates a plurality of scanning synchronization signals (S-SYNC), and provides the S-SYNC to the gate driving circuit 13. The gate driving circuit 13 thereby applies plural scanning signals to the scanning lines 131 sequentially. When one scanning line 131 is being scanned, the corresponding TFTs 16 that are connected to the scanning line 131 are switched on.

The timing controller 12 further generates a plurality of data synchronization signals (D-SYNC), and provides the D-SYNC to the data driving circuit 14. The data driving circuit 14 thereby applies plural gray scale voltages to the data lines 141 simultaneously each time one of the scanning lines 131 is being scanned. The gray scale voltages are applied to corresponding pixel electrodes 17 via corresponding on-state TFTs 16.

When a gray scale voltage is applied to each pixel electrode 17, an electric field is generated between the pixel electrode 17 and the corresponding common electrode 18. Generally, the scanning lines 131 and the data lines 141 are insulated from each other by an insulating layer provided therebetween. Therefore, parasitic capacitors are inevitably formed between the scanning lines 131 and the data lines 141. Each parasitic capacitor is capable of interfering with operation of the liquid crystal panel 11. In particular, when the gray scale voltages applied to the pixel electrode 17 are pulled up or pulled down rapidly, the voltage of the common electrode 18 corresponding to the pixel electrode 17 is correspondingly pulled up or pulled down due to a coupling effect of the parasitic capacitor. When this happens, the voltages of other common electrodes 18 are distorted correspondingly, and so-called ripples in voltages of other common electrodes 18 occurs. These disturbances are liable to impair the quality of images displayed by the LCD 10. Further, these disturbances are liable to induce crosstalk, which can degrade operation of the liquid crystal panel 11 and further impair the quality of images displayed by the LCD 10.

What is needed, therefore, is an LCD that can overcome the above-described deficiencies.

SUMMARY

In an exemplary embodiment, a liquid crystal display includes a common electrode capable of having a predetermined common voltage applied thereto, a first common voltage line connected to the common electrode, a second common voltage line connected to the common electrode, and a common voltage modulator connected to the first and second common voltage lines. The first and second common voltage lines have no overlap and being at opposite sides of the liquid crystal display. The common voltage modulator is configured to receive a distorted common voltage from the common electrode via the first common voltage line, and apply a corresponding compensating voltage to the common electrode via the second common voltage line.

Other aspects, novel features and advantages will become more apparent from the following detailed description when taken in conjunction with the accompanying drawings.

Figure 1:
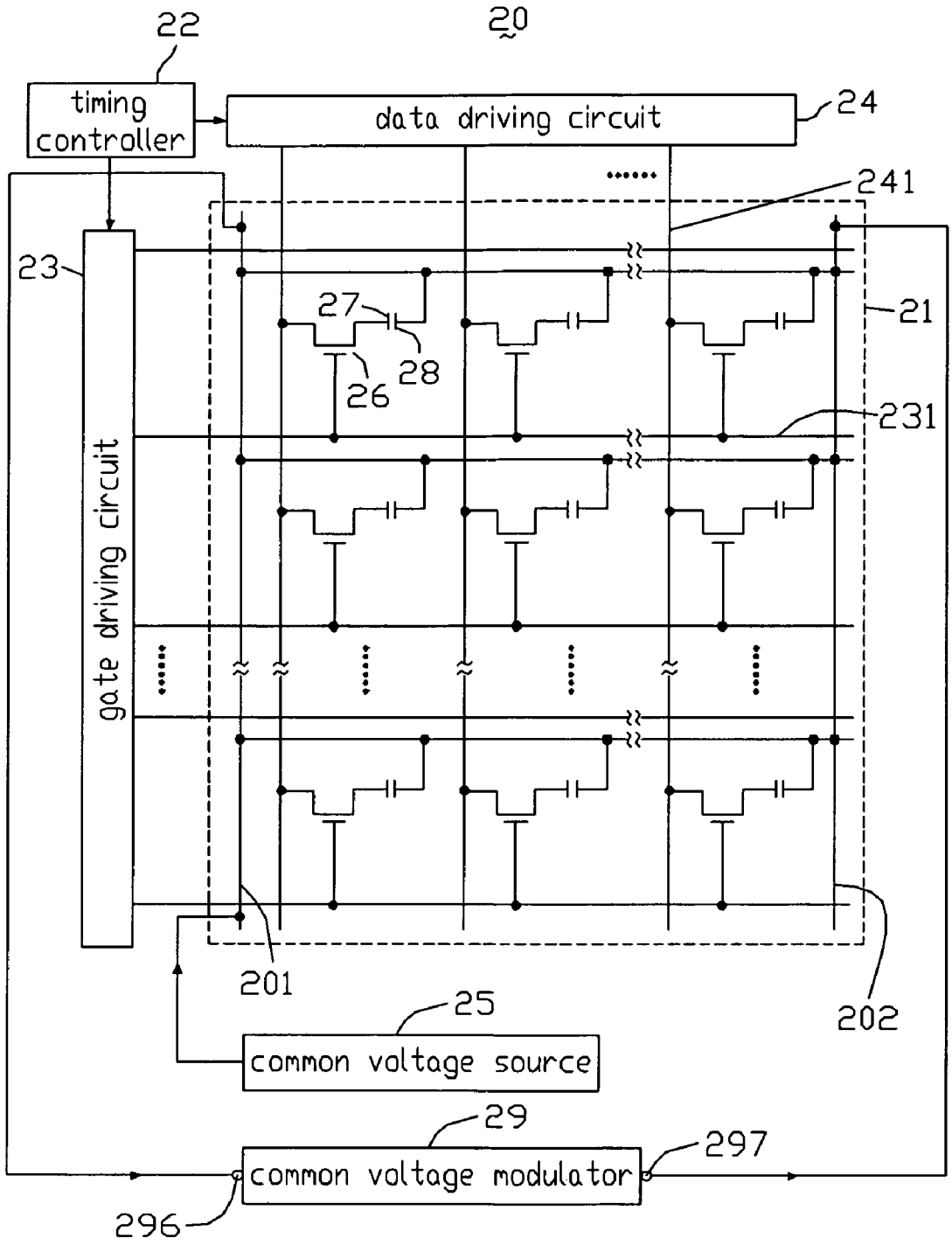
FIG. 1 is essentially an abbreviated circuit diagram of an LCD according to an exemplary embodiment of the present invention, the LCD device including a common voltage modulator.

The components in the drawings are not necessarily drawn to scale, the emphasis instead being placed upon clearly illustrating the principles of the described embodiments. In the drawings, like reference numerals designate corresponding parts throughout various views, and all the views are schematic.

DETAILED DESCRIPTION OF EMBODIMENTS

Referring to FIG. 1, an LCD 20 according to an exemplary embodiment of the present invention is shown. The LCD 20 includes a liquid crystal panel 21, a timing controller 22, a gate driving circuit 23, a data driving circuit 24, a common voltage source 25, and a common voltage modulator 29. The gate driving circuit 23 is used for providing a plurality of scanning signals to the liquid crystal panel 21. The data driving circuit 24 is used for providing a plurality of gray scale voltages to the liquid crystal panel 21. The timing controller 22 is used for controlling the gate driving circuit 23 and the data driving circuit 24. The common voltage source 25 is used for providing a predetermined common voltage to the liquid crystal panel 21. The common voltage modulator 29 is used for providing a plurality of compensating voltages to keep the common voltage stable.

The liquid crystal panel 21 includes a plurality of scanning lines 231 parallel to each other, a plurality of data lines 241 parallel to each other and orthogonal to the scanning lines 231, a plurality of TFTs 26 arranged in the vicinity of points of intersection of the scanning lines 231 and the data lines 241, a plurality of pixel electrodes 27 corresponding to the TFTs 26, a plurality of common electrodes 28 generally opposite to the pixel electrodes 27 respectively, a first common voltage line 201, and a second voltage line 202. The common voltage modulator 29 includes an input terminal 296 and an output terminal 297.

Each TFT 26 includes a gate electrode (not labeled) connected to the corresponding scanning line 231, a source electrode (not labeled) connected to the corresponding data line 241, and a drain electrode (not labeled) connected to the pixel electrode 27. The first and second common voltage lines 201, 202 are insulated from the scanning lines 231 and the data lines 241; and are arranged at two opposite edge portions of the liquid crystal panel 21, respectively near to and far from the gate driving circuit 23. Moreover, the first and second common voltage lines 201, 202 have no overlap and are parallel to each other. The first and second common voltage lines 201, 202 are also generally parallel to the data lines 241. A plurality of branch lines (not labeled) extend between the first and second common voltage lines 201, 202, each branch line connecting to a respective row of the common electrodes 28. Thereby, the common electrodes 28 are substantially connected to the common voltage source 25 via the first common voltage line 201. Thus, all the common electrodes 28 have the common voltage applied thereto. The common voltage is a constant direct current, and may for example be 5V. The common electrodes 28 are connected to the input terminal 296 also via the first common voltage line 201, and are connected to the output terminal 297 via the second common voltage line 202.

Figure 2:
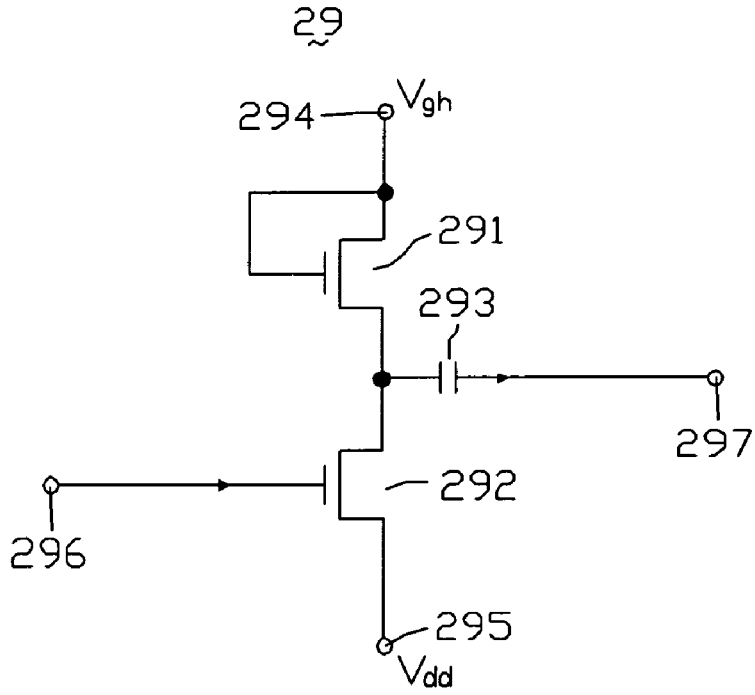
FIG. 2 is a circuit diagram of the common voltage modulator of FIG. 1.

Referring also to FIG. 2, a circuit diagram of the common voltage modulator 29 is shown. The common voltage modulator 29 includes a first transistor 291, a second transistor 292, a capacitor 293, a first direct current end 294, and a second direct current end 295. The first transistor 291 includes a gate electrode (not labeled) connected to the first direct current end 294, a source electrode (not labeled) also connected to the first direct current end 294, and a drain electrode (not labeled) connected to the second direct current end 295 via a drain electrode (not labeled) of the second transistor 292 and a source electrode (not labeled) of the second transistor 292. The second transistor 292 further includes a gate electrode (not labeled) connected to the input terminal 296. The drains of the first and second transistors 291, 292 are connected to the output terminal 297 via the capacitor 293. The first direct current end 294 has a high-level voltage Vgh applied thereto, and the second direct current end 295 has a low-level voltage Vdd applied thereto. The voltage Vgh may for example be 20V, and the voltage Vdd may for example be 1V. The first and second transistors 291, 292 may for example be TFTs.

The timing controller 22 generates a plurality of scanning synchronization signals, and provides the scanning synchronization signals to the gate driving circuit 23. The gate driving circuit 23 thereby applies plural scanning signals to the scanning lines 231 sequentially. When one scanning line 231 is being scanned, the corresponding TFTs 26 that are connected to the scanning line 231 are switched on.

The timing controller 22 further generates a plurality of data synchronization signals, and provides the scanning synchronization signals to the data driving circuit 24. The gate driving circuit 24 thereby applies plural gray scale voltages to the data lines 241 simultaneously each time one of the scanning lines 231 is being scanned. The gray scale voltages are applied to corresponding pixel electrodes 27 via the corresponding on-state TFTs 26.

Generally, the scanning lines 231 and the data lines 241 are insulated from each other by an insulating layer provided therebetween. Therefore, parasitic capacitors are formed between the scanning lines 231 and the data lines 241. When the gray scale voltages applied to the pixel electrodes 27 are pulled up or pulled down rapidly, the common voltages of the common electrodes 18 corresponding to the pixel electrodes 27 are correspondingly pulled up or pulled down due to the coupling effect of the parasitic capacitors. In this situation, the applied common voltage is distorted, and the distorted common voltage becomes an actual common voltage of each affected common electrode 28. The common voltage modulator 29 receives the distorted actual common voltage from the first common voltage line 201, and applies a corresponding compensating voltage to the second common voltage line 202. In the following description, for simplicity, the sum of the distorted actual common voltages will be referred to simply as "the distorted actual common voltage."

Figure 3:
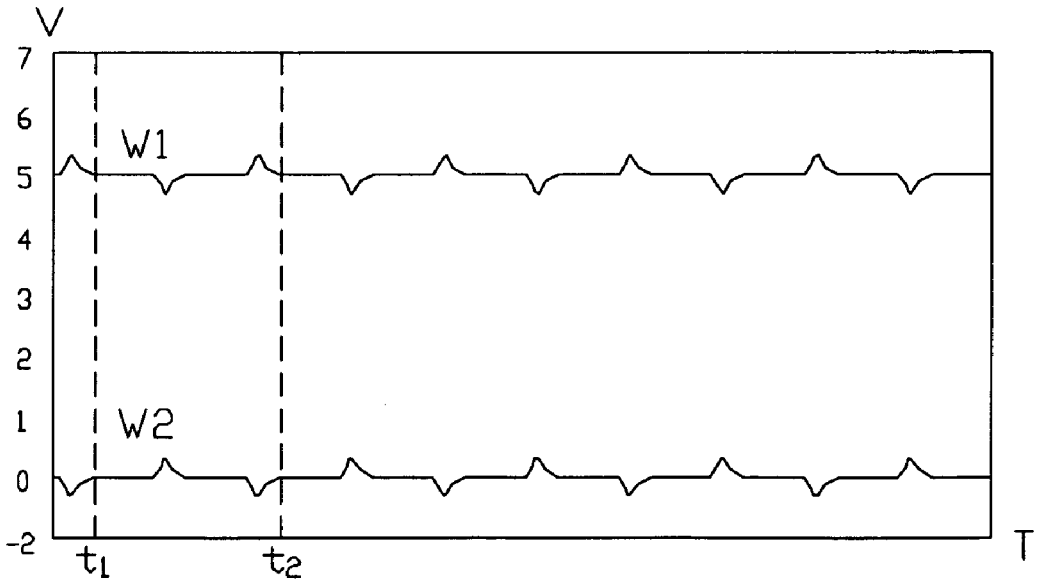
FIG. 3 is a schematic timing chart of waveforms illustrating a working principle of the common voltage modulator.
Figure 4:
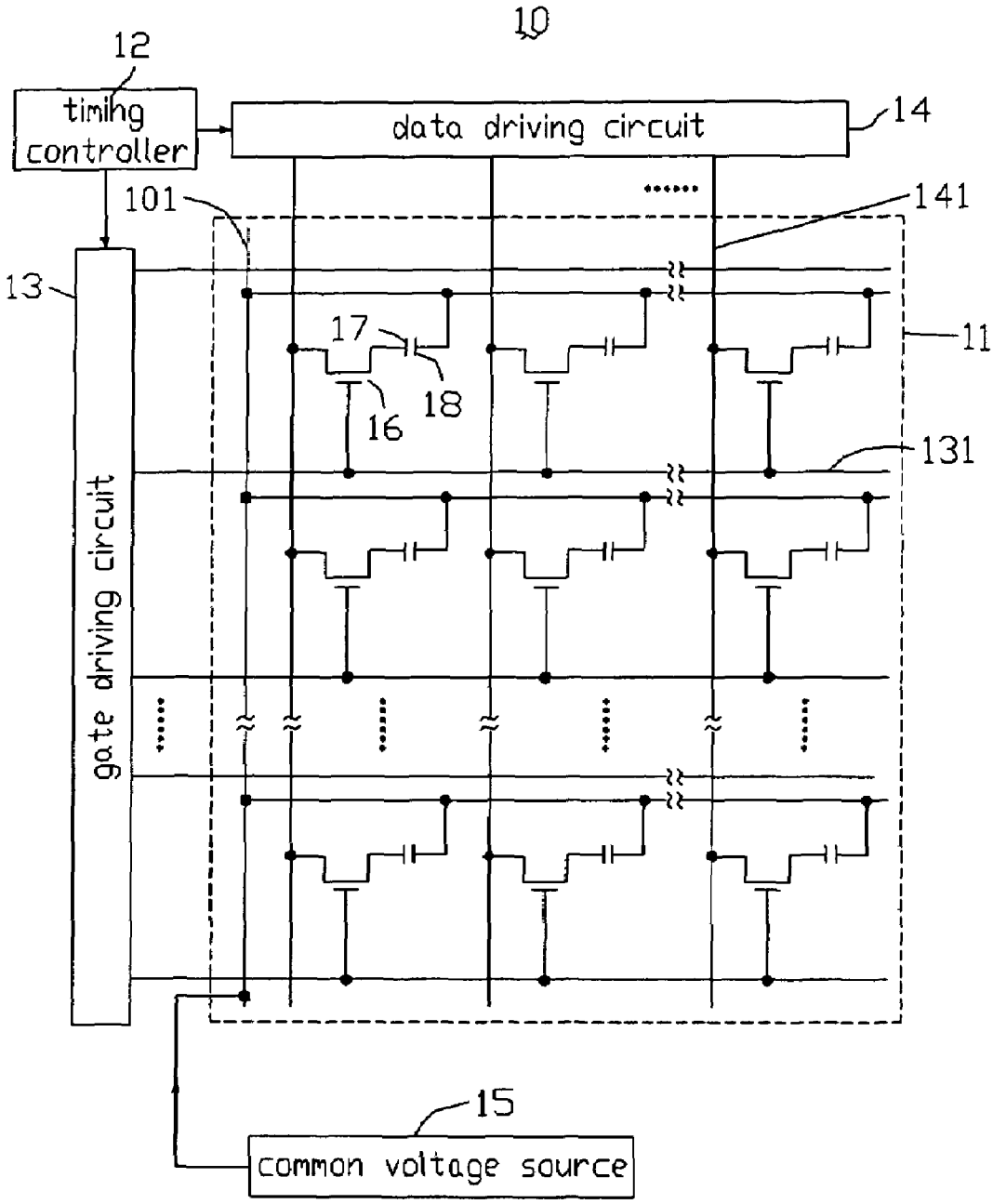
FIG. 4 (RELATED ART)
FIG. 4 is essentially an abbreviated circuit diagram of a conventional LCD.

Referring also to FIG. 3, this is a schematic timing chart of waveforms of the distorted actual common voltage and the compensating voltage. In the chart, W1 represents the waveform of the distorted common voltage, and W2 represents the waveform of the compensating voltage. As shown in FIG. 3, W1 has a number of upward and downward ripples occurring alternately, which ripples are due to the coupling effect. W2 has a number of upward ripples corresponding to the downward ripples of W1, and a number of downward ripples corresponding to the upward ripples of W1.

The working principle of the common voltage modulator 29 is described in detail as follows. A time period t1~t2 is taken as an example.

During the period t1~t2, when W1 is smooth with no ripples, the first transistor 291 is switched on. This is because the gate electrode of the first transistor 291 is connected to the first direct current end 294, which has a high-level voltage Vgh applied thereto. The second transistor 292 is switched on. This is because the gate electrode of the second transistor 292 is connected to the first common voltage line 201, which has a 5V common voltage applied thereto. At this time, no operation is performed to affect the capacitor 293, and the compensating voltage is 0V.

When W1 has a downward ripple, the common voltage applied to the gate electrode of the second transistor 292 is reduced. Thus, an on-state resistance between the source electrode and the drain electrode of the second transistor 292 is increased. Because the first direct current end 294 and the second direct current input 295 have constant voltages Vgh and Vdd applied thereto respectively, a voltage between the first direct current end 294 and the second direct current end 295 is constant. Thus, a voltage division of the second transistor 292 is increased. The voltage of the drain electrode of the second transistor 292 is increased. A voltage of one end of the capacitor 293 connected to the drain electrode of the second transistor 292 is increased. Thereby, a voltage of the other end of the capacitor 293 connected to the output terminal 297 is pulled up due to the coupling effect, and exceeds 0V. The compensating voltage output by the common voltage modulator 29 is thus greater than 0V, and has an upward ripple corresponding to the downward ripple of W1.

When W1 has an upward ripple, the common voltage applied to the gate electrode of the second transistor 292 is increased. Accordingly, the on-state resistance between the source electrode and the drain electrode of the second transistor 292 is reduced. Thus, the voltage division of the second transistor 292 is reduced. The voltage of the drain electrode of the second transistor 292 is reduced. The voltage of one end of the capacitor 293 connected to the drain electrode of the second transistor 292 is reduced. Thereby, the voltage of the other end of the capacitor 293 connected to the output terminal 297 is pulled down due to the coupling effect, and is below 0V. The compensating voltage output by the common voltage modulator 29 is thus less than 0V, and has a downward ripple corresponding to the upward ripple of W1.

In summary, each time the common voltage has a ripple, the compensating voltage immediately applied by the common voltage modulator 29 has a corresponding ripple but with a reverse orientation. The compensating voltage having the reverse orientation ripple is applied to the common electrodes 28 via the second common voltage line 202. Thus the ripple of the distorted common voltage is cancelled out or compensated, such that the common voltage of the common electrode 28 remains substantially stable. That is, the compensating voltage smoothes the distorted actual common voltage, whereby the actual common voltage can be almost exactly the same as the predetermined common voltage. Accordingly, impairment of images displayed by the LCD 20 is reduced or even eliminated, and the LCD 20 provides good performance.

For example, it has been demonstrated that when the high-level voltage Vgh is within a range from 15V to 25V, and the low-level voltage Vdd is within a range from 0V to 3.3V, the LCD 20 displays images of good quality.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A liquid crystal display comprising:

a common electrode capable of having a predetermined common voltage applied thereto;

a first common voltage line connected to the common electrode;

a second common voltage line connected the common electrode, the first and second common voltage lines being at opposite sides of the liquid crystal display; and a common voltage modulator connected to the first and second common voltage lines;

wherein the common voltage modulator comprises a first transistor, a second transistor, a first direct current end, a second direct current end, and a capacitor, the first transistor comprising a gate electrode connected to the first direct current end, and a source electrode connected to the first direct current end, the second transistor comprising a gate electrode connected to the first common voltage line, and a source electrode connected to the second direct current end, drain electrodes of the first and second transistors being directly connected to the second common voltage line via the capacitor;

wherein the common voltage modulator is configured to receive a distorted common voltage from the common electrode via the first common voltage line, generate a corresponding compensating voltage based on the distorted common voltage from the first common voltage line, and apply the corresponding compensating voltage to the common electrode via the second common voltage line.

2. A liquid crystal display comprising:

a common electrode;

a first common voltage line connected to the common electrode;

a second common voltage line connected to the common electrode;

a common voltage source connected to a first end of the first common voltage line and configured to supply a common voltage to the common electrode via the first common voltage line; and a common voltage modulator connected to a second end of the first common voltage line and the second common voltage line, and configured for receiving an actual common voltage from the first common voltage line, generating a corresponding compensating voltage based on the actual common voltage from the first common voltage line and providing the corresponding compensating voltage to the second common voltage line;

wherein the common voltage modulator comprises a first transistor, a second transistor, a first direct current end, a second direct current end, and a capacitor, the first transistor comprising a gate electrode connected to the first direct current end, and a source electrode connected to the first direct current end, the second transistor comprising a gate electrode connected to the first common voltage line, and a source electrode connected to the second direct current end, drain electrodes of the first and second transistors being directly connected to the second common voltage line via the capacitor;

wherein sum of the actual common voltage and the corresponding compensating voltage is substantially equal to the common voltage supplied by the common voltage source.

3. A liquid crystal display, comprising:

a common electrode;

a first common voltage line connected to the common electrode;

a second common voltage line connected the common electrode, the first and second common voltage lines being at two opposite sides of the liquid crystal display;

a common voltage source connected to a first end of the first common voltage line and configured to supply a common voltage to the common electrode via the first common voltage line;

a common voltage modulator connected to a second end of the first common voltage line and the second common voltage line; and wherein the common voltage modulator is configured to receive a distorted common voltage from only one of the first and second common voltage lines, generate a corresponding compensating voltage based on the distorted common voltage, and apply the corresponding compensating voltage to only the other one of the first and second common voltage lines;

wherein the common voltage modulator comprises a first transistor, a second transistor, a first direct current end, a second direct current end, and a capacitor, the first transistor comprising a gate electrode connected to the first direct current end, and a source electrode connected to the first direct current end, the second transistor comprising a gate electrode connected to the first common voltage line, and a source electrode connected to the second direct current end, drain electrodes of the first and second transistors being directly connected to the second common voltage line via the capacitor.

* * * * *